US006527307B2

(12) United States Patent
Welsh et al.

(10) Patent No.: US 6,527,307 B2
(45) Date of Patent: Mar. 4, 2003

(54) LINEAR COMPRESSION LATCH

(75) Inventors: Thomas Welsh, Philadelphia, PA (US); Charles R. Scally, Warminster, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/935,871

(22) Filed: Aug. 23, 2001

(65) Prior Publication Data

US 2002/0070561 A1 Jun. 13, 2002

Related U.S. Application Data

(60) Provisional application No. 60/228,333, filed on Aug. 27, 2000.

(51) Int. Cl.[7] ..... E05C 19/02
(52) U.S. Cl. ..... 292/70; 292/DIG. 31
(58) Field of Search ..... 292/70, 74, 139, 292/DIG. 31, 257, 143

(56) References Cited

U.S. PATENT DOCUMENTS

| | | | | | |
|---|---|---|---|---|---|
| 960,386 | A | * | 7/1910 | Obert | |
| 4,763,935 | A | * | 8/1988 | Bisbing | 292/66 |
| 4,991,886 | A | * | 2/1991 | Nolte | 292/161 |
| 5,590,921 | A | * | 1/1997 | Holtman | 292/257 |

OTHER PUBLICATIONS

Southco Inc., Latches and Access Hardware, Handbook 45 (1995), pp. F–2, E–2 through E–15, front and back covers.

* cited by examiner

*Primary Examiner*—Gary Estremsky
(74) *Attorney, Agent, or Firm*—Paul & Paul

(57) ABSTRACT

A linear compression latch includes a lever linked to a pawl. As the latch is opened the pawl is initially constrained to move vertically along with a carriage. After an intermediate position is achieved, the pawl is constrained to move horizontally within the carriage.

15 Claims, 9 Drawing Sheets

FIG. 15
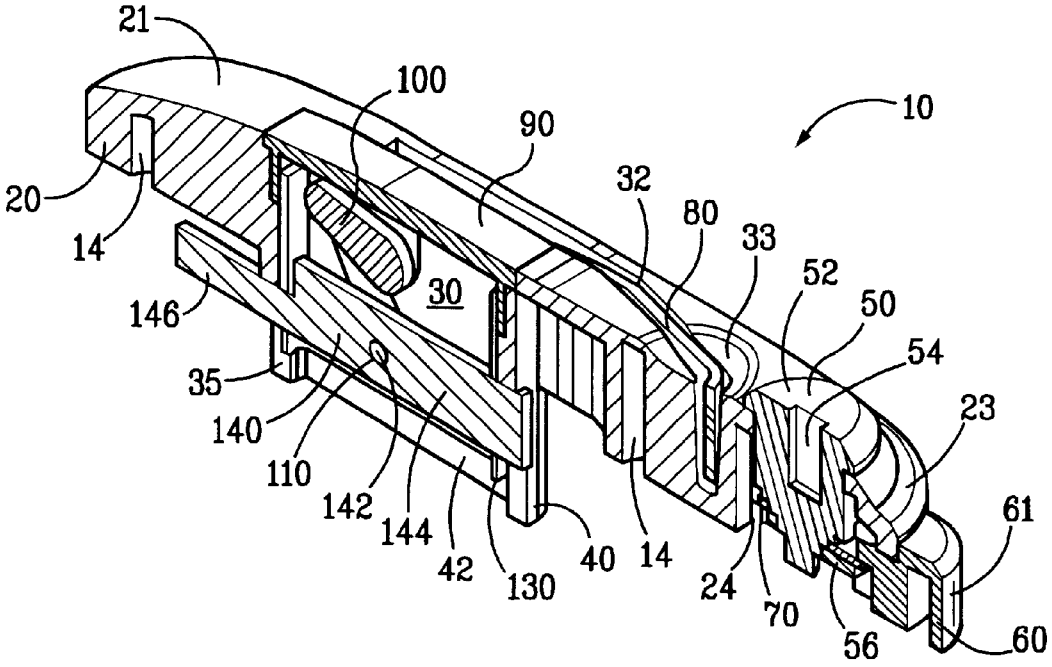
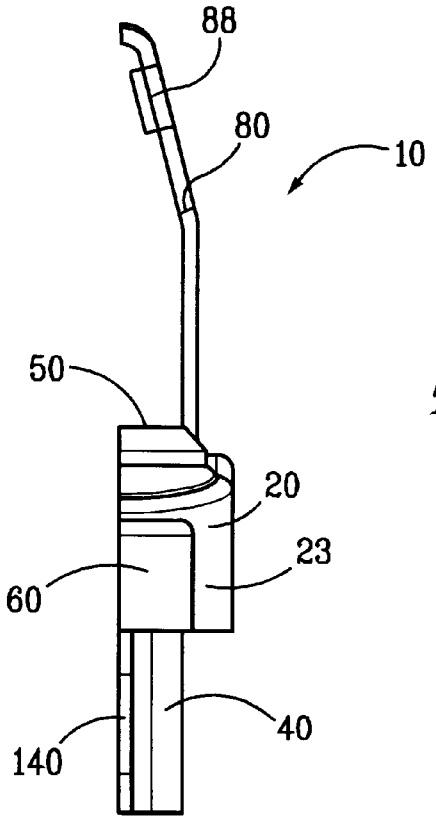
FIG. 18

LINEAR COMPRESSION LATCH

CROSS-REFERENCE TO RELATED APPLICATION

This application claims the benefit of U.S. Provisional Patent Application 60/228,333, filed Aug. 27, 2000.

BACKGROUND OF THE INVENTION

1. Field of the Invention

The present invention relates to compression latches for doors or panels.

2. Brief Description of the Prior Art

Compression latches for mounting on doors or panels are known. Compression latches are used in applications in which it is desirable to both latch a door or panel to the frame in which it is mounted and to seal the edge of the panel to the frame when closed. For example, compression latches are desirable when the opening in which the panel is mounted is provided with a gasket that must be compressed to provide a seal.

Examples of compression latches are provided in the Southco Handbook 2000 (Southco, Inc., Concordville, Pa.) at pages 23–69.

Fixed compression latches provide a consistent, pre-set compression while adjustable compression latches provide flexibility in setting the amount of compression.

Compression latches often include a pawl designed to engage the frame inside the enclosure to latch the panel shut. Since the compression latch must be operated from outside the enclosure, there must be a mechanism linking the portion of the latch operated by the user with the pawl positioned inside the enclosure. Further, often the latch mechanism, or at least a substantial portion thereof, protrudes through an aperture in the panel. The latch mechanism itself can reduce the volume of the sealed interior that would otherwise available.

In some applications, such as cabinets for radio transmitters and telephone equipment for outdoor use, the enclosure preferably remains well sealed against the environment, to avoid environmental stresses penetrating into the enclosure and to avoid EMI leakage from equipment to the environment. Thus, in such applications, the latch mounting aperture and the latch itself may present routes between the interior of the enclosure and the exterior, undesirably reducing the degree of isolation of the enclosure from the environment.

There is a continuing need for a simple, easy to install compression latch that provides suitable compression force and yet reduces the extent to which the environmental isolation of the enclosure is compromised by installation and use of the latch.

There is also a continuing need for a compression latch that provides a minimal "footprint" inside the cabinet on which the compression latch is installed.

SUMMARY OF THE INVENTION

The present invention provides a simple linear compression latch that can be easily and securely mounted on the outside of a door or panel. The linear compression latch of the present invention provides a consistent, pre-set compression. At the same time, only a small portion of the latch mechanism protrudes into the interior of the enclosure, so that the cabinet is easy to seal against the environment. The linear compression latch of the present invention is simple to manufacture, assemble and install, and is preferably assembled from less than a dozen parts.

Since most of the latch mechanism is located outside the enclosure, the linear compression latch of the present invention takes up a minimum of useable space within the enclosure, thus minimizing or eliminating the space previously used by other types of compression latches inside the sealed area of a cabinet. The linear compression latch of the present invention provides a single-point compression between a door and a frame.

The compression is provided by a pawl, which moves toward the door as the handle of the latch is closed. The pawl moves by "linear motion" meaning that it moves substantially only in the plane parallel to the surface of the door. To open the linear compression latch, a lever is pulled upward, away from the latch. This causes the pawl to initially move away from the door frame, and then to withdraw from under the door frame to a position under the door so that the door can be opened. Overall, the pawl moves in an "L"-shaped motion.

The linear compression latch includes a housing and a lever mounted in the housing and rotatable by an operator between a first position and a second position. The latch also includes a pawl mounted for substantially linear motion. The pawl is actuated by rotation of the lever, travels substantially linearly between an open position to a closed position as the lever is rotated between the first position to second position. Preferably, the pawl is mounted to travel between the open position along a first path and an intermediate position, and then to travel in a second path in a direction substantially perpendicular to the first path between the intermediate position and the closed position. For example, when the latch is being opened, the pawl initially travels downward along a substantially linear path from a first position to an intermediate position, then it travels in a second linear path away from the door frame from the intermediate position to the second position in which the entire pawl is positioned under the door, the latch is fully open, and the door can be opened.

Preferably, the linear compression latch also comprises a carriage that is mounted for linear motion within the housing. In this case the pawl is mounted within the carriage, and the carriage is displaced with the pawl as the pawl travels along the first path. In the closed position the pawl presses upward against the underside of the door frame to compress a gasket between the door and the door frame. When the latch is opened, the pawl and the carriage initially travel downward away from the door frame to release the compression on the gasket. Preferably, the latch also includes a link means for linking the lever and the pawl. Preferably, the link means is rotatably affixed to both one of the arms of the lever and rotatably affixed to the pawl as well. Preferably, connection means, such as a cylindrical pin, are provided to rotatably connect the link means and the pawl. It is also preferred that the connection means also rotatably connects the pawl and the carriage. Further, it is preferred that the lever have a first arm and a second arm that are not collinear, and instead orient at an angle less than 180 degrees to each other.

It is thus an object of the present invention to provide a compression latch having a substantially linear motion.

It is also an object of the present invention to provide a compression latch having a mechanism which is located substantially outside the enclosure on which the compression latch is mounted.

It is a further object of the present invention to provide a compression latch that can be easily and effectively sealed.

It is a further object of the present invention to provide a compression latch of a design that reduces the need to provide a seal for the latch itself when used in an enclosure that it preferably isolated from its environment.

These and other objects of the invention will become apparent through the following description and claims.

BRIEF DESCRIPTION OF THE DRAWINGS

FIG. 15 is a perspective sectional view of the latch of FIG. 14.

FIG. 18 is a front elevational sectional view of the latch of FIG. 16.

DETAILED DESCRIPTION OF THE PREFERRED EMBODIMENT

The present invention provides a simple linear compression latch that can be easily and securely mounted on the outside of a door or panel. The linear compression latch of the present invention provides a consistent, pre-set compression. At the same time, only a small portion of the latch mechanism protrudes into the interior of the enclosure, so that the latch is easy to seal against the environment. The linear compression latch of the present invention is simple to manufacture, assemble and install, and is preferably assembled from less than a dozen parts.

Figure 1:
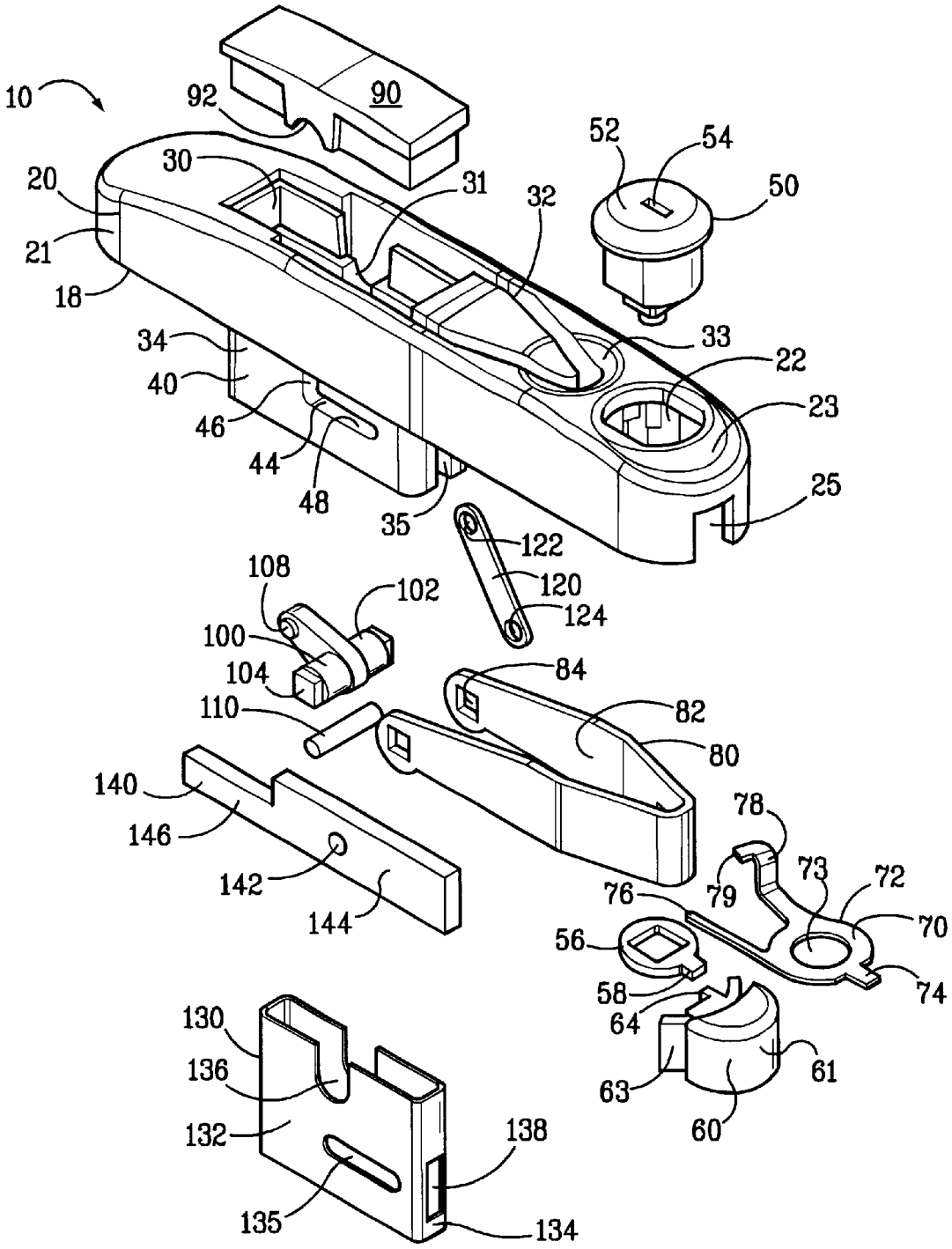
FIG. 1 is a exploded perspective view of a linear compression latch according to the present invention.

Referring now to the figures in which like reference numerals refer to like elements in each of the several views, there is shown in FIG. 1 a linear compression latch 10 according to the present invention in an exploded perspective view.

Figure 14:
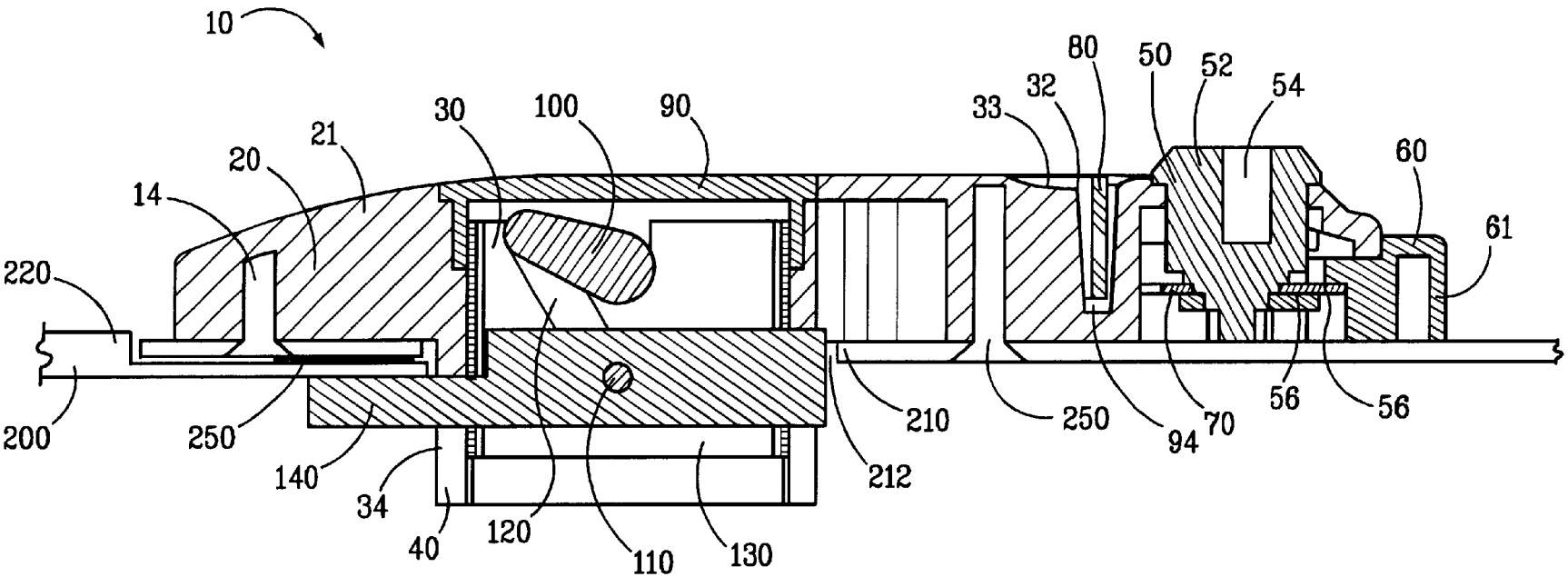
FIG. 14 is a side elevational section view of the latch of FIG. 2 taken along the lines 14—14 if FIG. 2 showing the latch in a closed and latched position and mounted on a door that the latch secures to a door frame.

The linear compression latch 10 includes an elongated housing 20 for mounting on the outside of a door or panel 210 of a cabinet or enclosure 200 having a frame 220 (FIG. 14). The housing 20 includes an upper portion 21 having a generally planar bottom 18 (best seen in FIG. 4), a central cavity or well 30 in which much of the latch mechanism is housed as described below, and a lower portion 40 that extends downward from central cavity 30 of the upper portion 21. A gasket 230 can be provided to form a seal between the frame 220 and the door 210 when the door 210 is closed and latched (FIG. 14). A substantially planar cover 90 is provided to generally enclose the central cavity 30 and conceal the latch mechanism.

The latch 10 is installed in an aperture 212 formed in the door 210 proximate the edge thereof. The installation aperture 212 is sized to receive the lower portion 40 of the housing 20. When the latch 20 is mounted on the door 210, the lower portion 40 of the housing 20 extends through the installation aperture 212 into the interior of the enclosure, while the upper portion 21 of the housing 20 remains on the outside of the door 210, positioned flush against the door 210. The latch 10 is preferably affixed to the door 210 using conventional fasteners such as machine screws 250 and fastener-receiving mounting means 14 formed in the housing 20.

Figure 19:
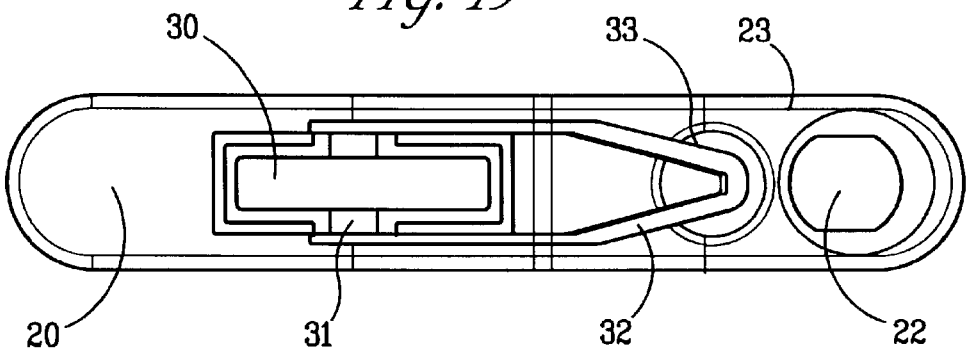
FIG. 19 is top plan view of the housing of the latch of FIG. 1.

As shown in FIG. 1, the linear compression latch 10 preferably includes a conventional lockplug 50 having a cylinder 52 that can be rotated from a locked position to an open position by insertion of a key (not shown) in the key slot 54. The lockplug 50 is accessible through an opening 22 formed in the housing 20 proximate the front end 23 of the housing 20 (best seen in the top plan view of the housing, FIG. 19). The housing 20 has a front chamber 24 formed therein (best seen in the bottom plan view of FIG. 5) and adapted to receive the lockplug 50. A cam 56 (best seen in FIG. 1 and the bottom plan view of FIG. 5), provided with a protruding finger 58, is mounted on the bottom of the lockplug 50 to the cylinder 52 so that when the cylinder 52 of the lockplug 50 is rotated within the chamber 22, the cam 56 also rotates.

As can be seen in FIG. 1, the front end 23 of the housing 20 has a generally rectangular opening 25 formed therein for receiving a button 60 having a generally half-cylindrical exterior body 61 and a generally arcuate interior extension 62 connected by a central wall 63, best seen in FIGS. 8–12. A first wall 64 and a second wall 65 extend backward from the central portion 66 of the interior extension 62, the first wall 64 extending further back than the second wall 65. As best seen in the bottom plan view of FIG. 5, the interior extension 62 is received within a complementary arcuate slot 26 formed inside the housing 20 adjacent the front chamber 22, so that the button 60 can be displaced through a small angle by the operator from a first or closed position, as shown in FIG. 5 to a second or open position (not shown, but upward in FIG. 4), the displacement of the button 60 preferably being limited by the width of the rectangular opening 25 or the size of the arcuate slot 26.

Figure 5:
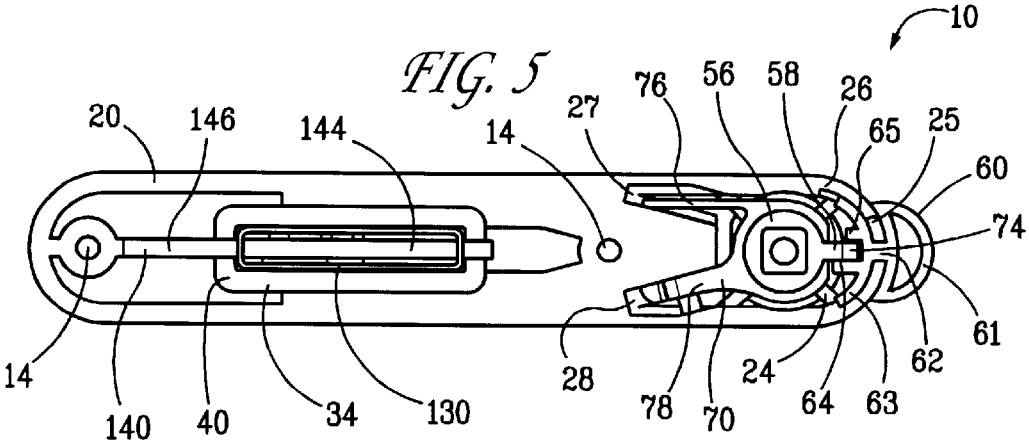
FIG. 5 is a bottom plan view of the latch of FIG. 1 shown in a closed and latched position.

When the lockplug 50 is in the locked position, such as can be seen in FIG. 5, the finger 58 of the cam 56 fixed to the cylinder 52 of the lockplug 50 is positioned between the first wall 64 and the second wall 65 of the button 60, so that the button 60 cannot be displaced. After the lockplug 60 has been rotated by the operator from a locked to an unlocked position to unlock the latch 10, the finger 58 of the cam 56 no longer prevents the button 60 from been radially displaced within the slot 26. When the operator radially displaces the button 60, the button 60 contacts and rotationally displaces a trigger 70 (FIG. 5) which in turn releases the handle 100 (FIG. 1) so that the operator can then grasp the handle 100 to displace the pawl 140 as described below.

Figure 13:
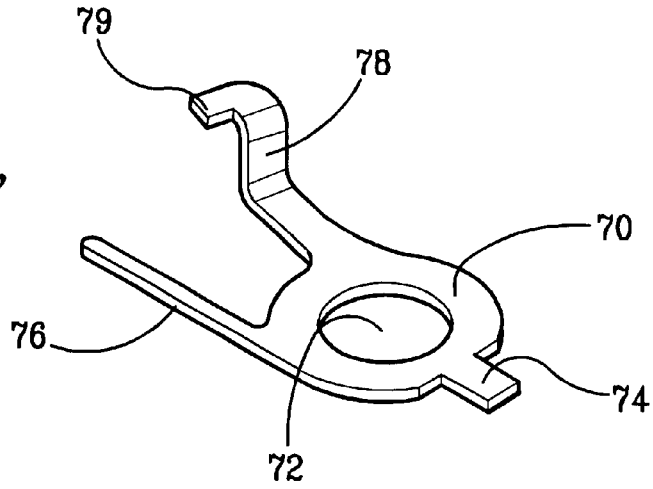
FIG. 13 is a perspective view of the trigger of the latch of FIG. 1.
Figure 6:
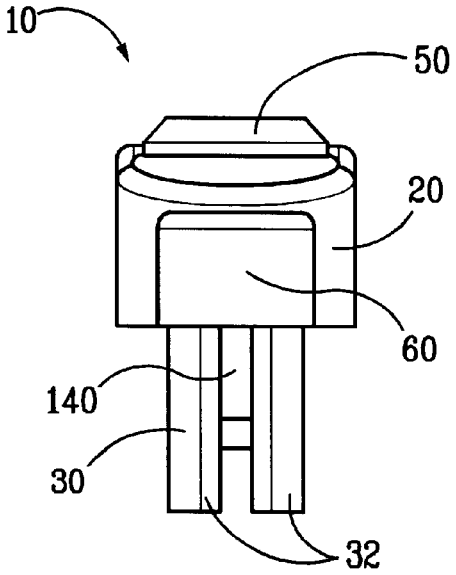
FIG. 6 is a front elevational view of the latch of FIG. 1 shown in a closed and latched position.
Figure 7:
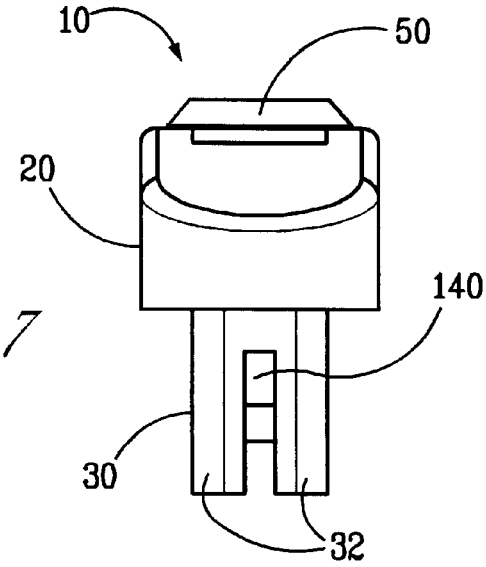
FIG. 7 is a rear elevational view of the latch of FIG. 1 shown in a closed and latched position.
Figure 8:
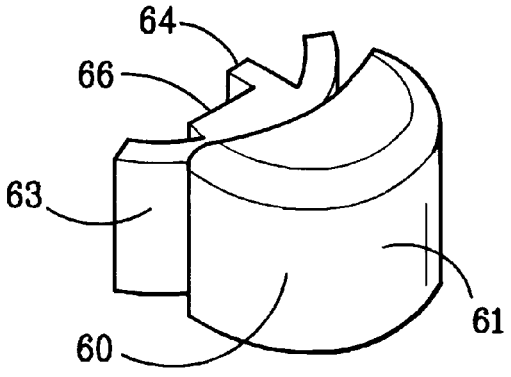
FIG. 8 is a perspective view of the button of the latch of FIG. 1.
Figure 9:
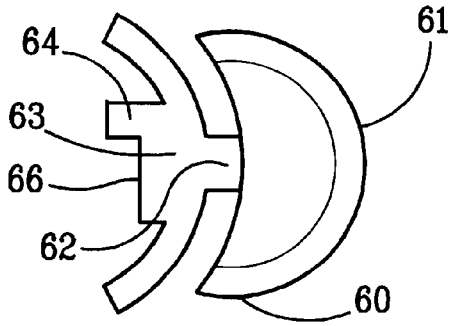
FIG. 9 is a top plan view of the button of FIG. 8.
Figure 10:
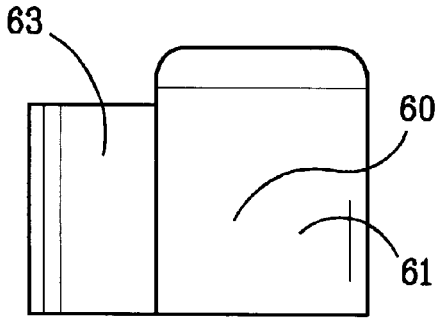
FIG. 10 is a side elevational view of the button of FIG. 8.
Figure 11:
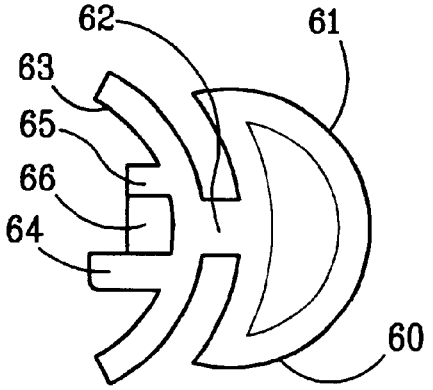
FIG. 11 is a bottom plan view of the button of FIG. 8.
Figure 12:
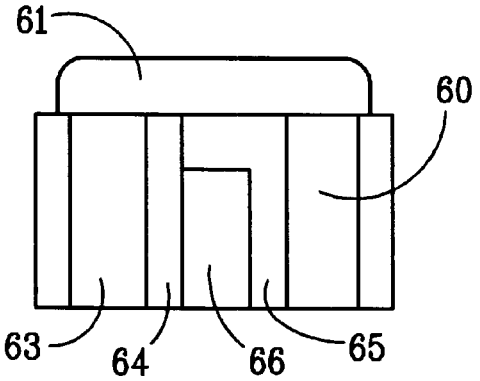
FIG. 12 is a rear elevational view of the button of FIG. 8.

As best seen in FIG. 13, the trigger 70 includes a ring-like central portion 72 having a circular opening 73 sized to freely rotate about the lockplug 50 when the latch 10 is assembled (FIG. 5). The trigger 70 is preferably formed from a resilient material such as spring steel or a resilient plastic material. As best seen in FIG. 13, the trigger 70 includes a tab 74 extending forward from the central ring portion 72, as well as a spring arm 76 and an actuating arm 78 extending backward from the central ring portion 72. As can be seen in FIG. 5, the front chamber 24 of the housing 20 includes a first elongated cavity 27 sized and positioned to receive the spring arm 76 of the trigger 70 as well as a second elongated cavity 28 sized and positioned to receive the actuating arm 78 of the trigger 70.

When the button 60 is displaced by the operator (upward in FIG. 5) the first wall 64 of the button 60 contacts and displaces the tab 74 of the trigger 70, causing the trigger 70 to rotate (counterclockwise in FIG. 5) about the lockplug 50. As the trigger 70 rotates, the spring arm 76, in contact with the wall of the first elongated cavity 27, provides a counteracting rotational biasing force, which serves to return the trigger 70 and button 60 to their initial position when the operator releases the button 60. At the same time the actuating arm 78 of the trigger 70 is rotationally displaced in the second elongated cavity 28.

Figure 2:
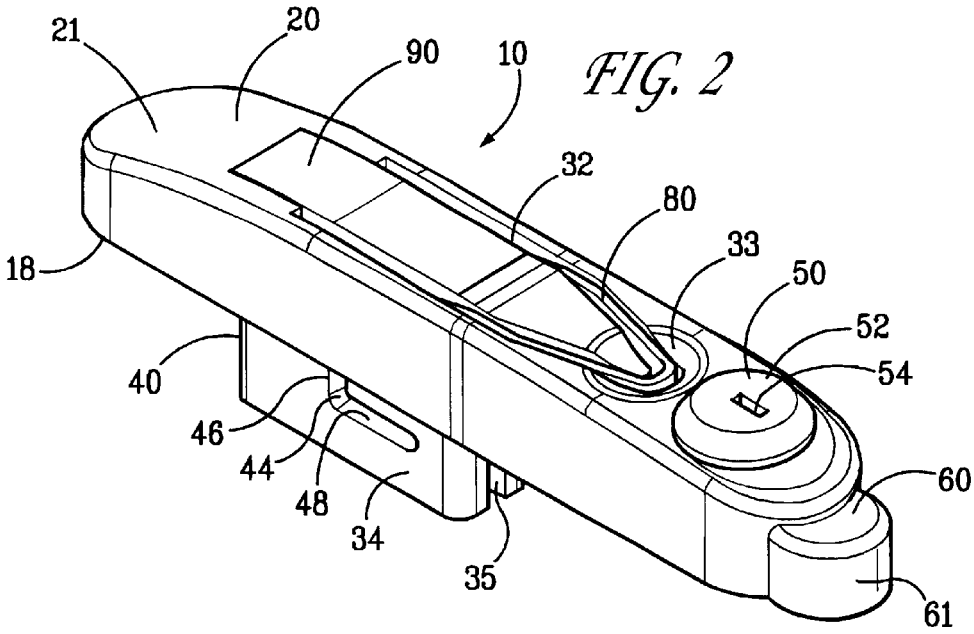
FIG. 2 is a perspective view of the latch of FIG. 1 shown in a closed and latched position.
Figure 3:
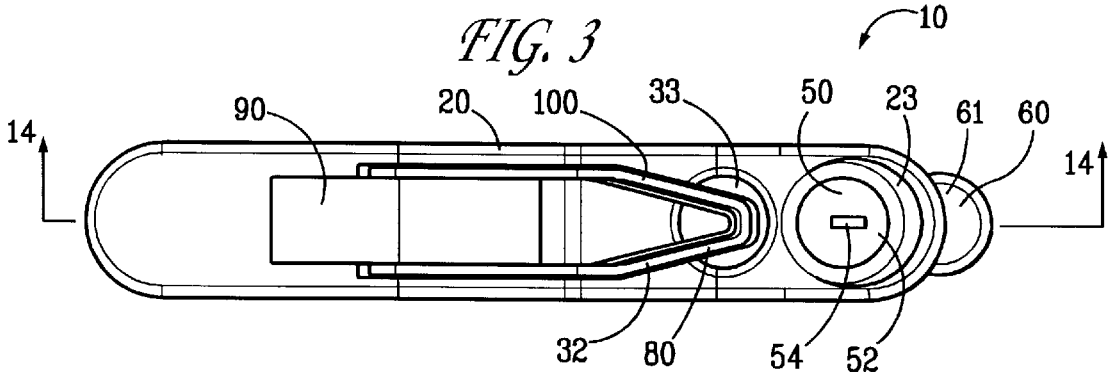
FIG. 3 is a top plan view of the latch of FIG. 1 shown in a closed and latched position.
Figure 16:
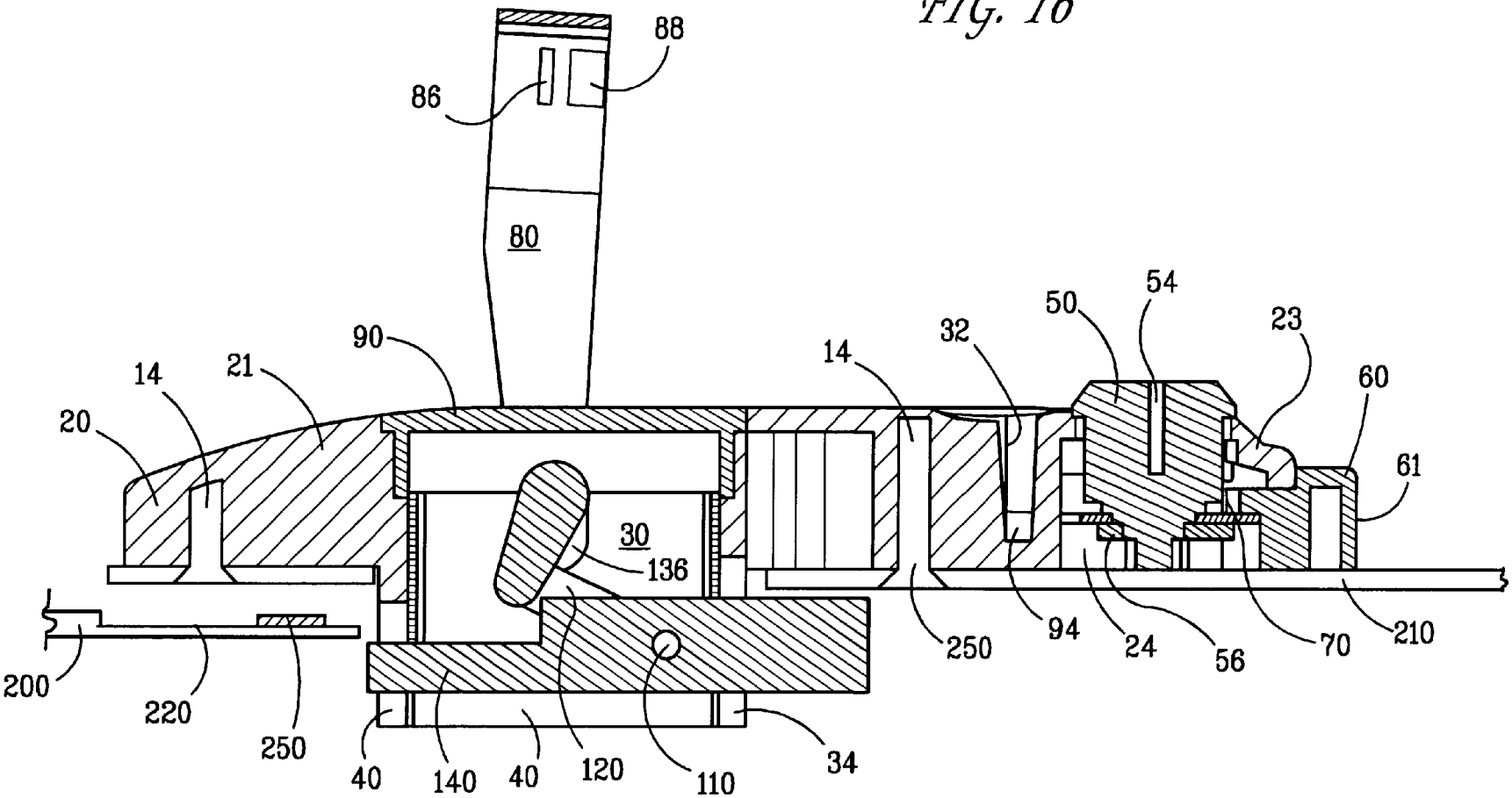
FIG. 16 is a side elevational view of the latch of FIG. 14 showing the latch in an open position.
Figure 17:
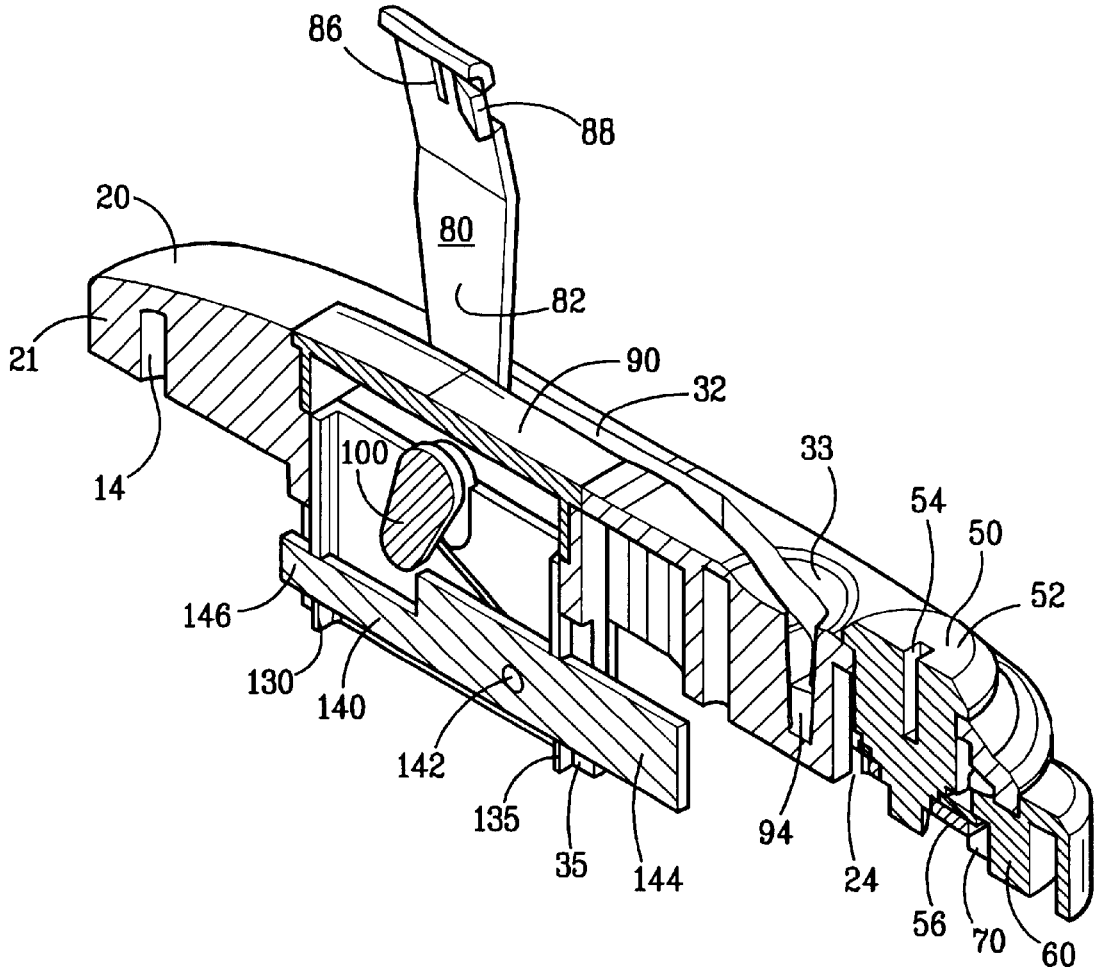
FIG. 17 is a perspective sectional view of the latch of FIG. 16.

As best seen in FIGS. 16 and 17, the housing 20 includes a generally "V"-shaped cavity 32 formed in the top of the housing 20 and positioned behind the front chamber 24 and the lockplug 50. The second elongated cavity 27 communicates with the "V"-shaped cavity 32. The "V"-shaped cavity 32 in the housing 20 is adapted to receive a generally "V"-shaped handle 80, best seen in FIG. 1, having a pair of generally parallel legs 82. The handle 80 is spring-loaded by a compression spring 94 (FIGS. 14 and 16) positioned at the forward end of the "V"-shaped cavity 32 below the handle 80. A generally circular depression 33 (FIG. 2) is formed in the top of the housing 20 centered on the front of the "V"-shaped cavity 32 to expose the upper edge of the handle 80 and to help the operator grasp the handle 80.

To open the latch 10, the operator grasps the handle 80 and rotates the handle 80 from the closed position upward, thereby withdrawing the pawl 140 from engagement with the door frame 220, as effected through the latch mechanism as described below. Conversely, to close and engage the latch 10, the operator rotates the latch handle 80 from the open position (FIGS. 16, 17 and 18) downward to the closed position (FIGS. 14 and 15) to push the pawl 140 into engagement with the underside of the door frame 220.

As best seen in the sectional views of FIGS. 16, 17, and 18, which show the latch 10 in an open and unlatched position, the handle 80 has a locking slot 86 formed in one of the legs 82 proximate the upper end of the handle 80. Immediately adjacent and below the locking slot 86, a camming ramp 88 is formed in the handle 80. The actuating arm 78 of the trigger 70 is provided with a locking tab 79 formed at the end thereof, such that when the latch 10 is in the closed and latched position, the locking tab 79 of the trigger 70 is received within the locking slot 86 of the handle 80, thereby retaining the handle 80 within the "V"-shaped cavity 32.

When the button 60 is displaced by the operator, the trigger 70 rotates as described above, and the locking tab 79 of the trigger 70 moves out of the locking slot 86, thereby permitting the spring 94 to push the handle 80 at least partially out of the "V"-shaped cavity 32 so that the handle 80 can be grasped by the operator. Conversely, when the latch 10 is being closed, the operator pushes the handle 80 into the "V"-shaped cavity against the bias of the spring 92. The locking tab 79 of the trigger 70 is engaged by the camming ramp 88 which cams the actuating arm 78 of the trigger 70 outward until the locking tab 79 snaps into the locking slot 86.

The legs 82 of the handle 80 each have a generally square aperture 84 formed therein proximate the distal ends thereof. The handle 80 is secured to a lever handle 100 having a pair of opposed, collinear cylindrical shaft segments 102, each shaft segment 102 terminating in a square plug 104 adapted to be securely received within a respective one of the apertures 84 formed in the ends of the handle 80. The lever handle 100 includes an arm 106 extending perpendicularly from between the shaft segments 102 and having a pair of outwardly extending collinear cylindrical bosses or posts 108 formed at the distal end of the arm 106, the respective axes of the shaft segments 102 and the posts 108 being parallel to each other. When assembled, the handle 80 and the lever handle 100 form a lever, the handle 80 functioning as the longer arm, the arm 106 of the lever handle 100 serving as the shorter arm, and the shaft segments 102 providing the fulcrum. The two arms of the lever are not coaxial, but instead form an angle less than 180 degrees with one another. The angle between the arms of the lever is about 170 degrees.

Figure 4:
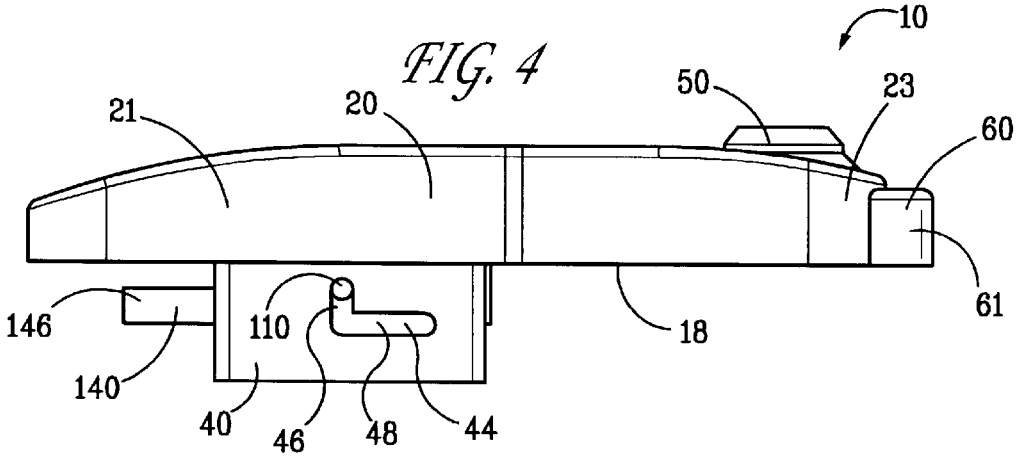
FIG. 4 is a side elevational view of the latch of FIG. 1 shown in a closed and latched position.

As best seen in FIGS. 4 and 5, the lower portion 40 of housing 20 includes a pair of spaced, generally parallel, generally planar support walls 34 extending downwardly from the bottom 18 of the upper portion 21 of the housing 20. The support walls 34 are curved to extend inwardly at the sides thereof, a pair of parallel vertically extending slots 35 (FIG. 2) being formed between the ends of the support walls 34. The support walls 34 each include a respective generally "L"-shaped slot formed therein. Each "L"-shaped slot 44 includes a horizontally extending long portion 46 and a vertically extending short portion 48, the short portion 48 extending upwardly from the long portion 46 at the inward end of the long portion 46.

As best seen in FIG. 1, the latch 10 further includes a box-like carriage 130 adapted to be received between the support walls 34. In operation of the latch 10 the carriage 130 travels linearly up and down between the support walls 34. The carriage 130 has a generally rectangular cross section formed by a pair of spaced opposing side walls 132 and a pair of spaced, opposing end walls 134. The side walls 132 each include an elongated, horizontally extending linear slot 135 and a "U"-shaped cutout 136 formed in the upper ends of the side walls 132. The end walls 134 each include a linear, vertically extending opening 138 for receiving the pawl 140.

The elongated, bar-like pawl 140 has a single circular aperture 142 formed therein proximate the middle of the pawl 140. The pawl 140 includes a first section or body 144 having a generally rectangular cross section. Extending from one end of the body 144 is second section or finger 146 also having a generally rectangular cross section but lesser in height than the body 144. When the latch 10 is assembled, the pawl 140 extends generally horizontally through the openings 138 in the end walls 134 of the carriage 130 and through the vertically extending slots 35 formed between the support walls 34 of the lower portion of the housing 20.

As can be seen in FIGS. 1 and 14–17, the latch 10 also includes a pair of elongated, generally planar links 120 each having a pair of circular apertures 122, 124 formed proximate the respective first and second ends thereof and a generally cylindrical pin 110 (FIG. 1).

When the latch 10 is assembled, a first end of each of the links 120 is rotatably mounted on a respective post 108 of the lever handle 100, the post 108 being received within one of the circular apertures 122 formed in the link 120.

When the latch 10 is assembled, the pin 110 is positioned to pass through (1) the "L"-shaped slots 44 formed in the support walls 34 of the lower portion 21 of the housing 20, (2) the linear, horizontally extending slots 135 formed in the side walls 132 of the carriage 130, (3) the circular apertures 124 formed in the second ends of the pair of links 120, and (4) the circular aperture 142 formed in the pawl 140. The pin 110 is preferably securely mounted within the circular aperture 142 formed in the pawl 140 so that the pin 110 and pawl 140 move as a unit.

The "L"-shaped slots 44 formed in the support walls 34 of the lower portion 31 of the housing 20 and the horizontally extending slots 135 formed in the side walls 132 of the carriage 130 serve to guide the motion of the pin 110 and pawl 140.

When the latch 10 is assembled, the shaft segments 102 of the lever handle 100 are received within and bear upon a pair of generally half-cylindrical first bearing surfaces 31 formed in the central cavity 30 of the housing 20 (best seen in FIG. 19) and a respective pair of generally half cylindrical second bearing surfaces 92 formed in the underside of the cover 90 (best seen in FIG. 1). The "U"-shaped cutouts 136 formed in the upper ends of the side walls 132 of the carriage 130 permit the carriage 130 to travel up inside the central cavity 30 without contacting the shaft segments 102.

When the latch 10 is in the closed and latched position, such as shown in FIG. 14, the pawl 140 is fully extended inwardly and upwardly into contact with the inside of the door frame 220, and each end of the pin 110 is located at the top of the respective short vertically extending arm 46 of a respective "L"-shaped slot 44 formed in the support wall 44.

To operate the latch 10 after the handle 80 has been released to open the latch 10 as described above, the operator pulls the handle 80 upward, rotating the handle 80 upward and the lever handle 100 downward, the shaft segments 102 of the lever handle 100 rotating on the bearing surfaces 31 formed in the central cavity 30 of the housing 20. As the lever handle 100 rotates downward, the links 120 transmit the motion of the lever handle 100 to the pin 110. The pin 110, being constrained to travel within both the "L"-shaped slots formed in the support walls 34 and the linear slots 135 formed in the carriage 130, initially travels downward from a first or closed position in the short portions 46 of the "L"-shaped slots 44, carrying both the pawl 140 and the carriage 130 downward to an intermediate position, where the short portions 46 and the long portions 48 of the "L"-shaped slots 44 meet.

This downward motion "decompresses" the latch 10, and releases the gasket 250 (FIGS. 14 and 16)as the pawl 140 is carried downward away from contact with the bottom of the edge of the door frame. When the pin 110 reaches the end of its travel within the short legs of the "L"-shaped slots, the continued downward rotational motion of the lever handle 100 forces the pin 110 to move forward simultaneously in both the horizontally extending long portions 48 of the "L"-shaped slots 44 formed in the support walls 34 and the horizontal slots 135 in the carriage, moving the pawl 140 forward horizontally, away from the door frame 220, so that the door 210 can be opened. The pin 110 and pawl 140 thus move "forward" along the horizontally extending long portions 48 of the "L"-shaped slots 44 and the horizontal slots 135 in the carriage 130 from an intermediate position to a second or open position.

When the latch 10 is closed by rotating the handle 80 downward, the pin 100 and pawl 140 retrace their motion from the second position to the intermediate position, the pawl 140 being moved "inward" towards the underside of the door frame 220. Continued motion of the handle 80 downward forces the pin 110 to travel upward from the intermediate position to the first or closed position, lifting the pawl 140 into contact with the underside of the door frame 220 and compressing the gasket 250.

Although the pawl 140 is rotatably connected to the links 120 though the pin 110, the pawl 140 has only a limited angular range of rotation, because the rotation of the pawl is limited by contact of the pawl 140 with the upper and lower edges of the horizontally extending slots 138 formed in the end walls 134 of the carriage 130.

It is preferred that the latch 10 be constructed of a suitable, sufficiently strong and rigid plastic material, a metal, a combination of metal and plastic materials, or other suitable materials.

It is to be understood that the invention is not limited to the preferred embodiment described herein, but encompasses all embodiments within the scope of the following claims.

We claim:

1. A linear compression latch comprising:

a housing;

a lever rotatable about an axis by an operator between a first position and a second position, the lever being mounted in the housing;

a pawl mounted for substantially linear motion, the pawl being actuated by rotation of the lever and traveling substantially linearly between an open position to a closed position as the lever is rotated between the first position to second position;

wherein the pawl is mounted to travel between the open position along a first path and an intermediate position; and wherein the pawl is mounted to travel in a second path in a direction substantially perpendicular to the first path between the intermediate position and the closed position.

2. A linear compression latch according to claim 1 wherein the first path is linear.

3. A linear compression latch according to claim 1 wherein the second path is linear.

4. A linear compression latch according to claim 3 further comprising a carriage, the carriage being mounted for linear motion within the housing, the pawl being mounted within the carriage, the carriage being displaced with the pawl as the pawl travels along the second path.

5. A linear compression latch according to claim 4 further comprising link means for linking the lever and the pawl.

6. A linear compression latch according to claim 5 further comprising connection means for rotatably connecting the link means and the pawl.

7. A linear compression latch according to claim 6 wherein the connection means also rotatably connects the pawl and the carriage.

8. A linear compression latch according to claim 7, the lever having a first arm and a second arm, the first and second arm being non-collinear.

9. A linear compression latch comprising:

a housing;

a lever rotatable by an operator between a first position and a second position, the lever being mounted in the housing;

a pawl mounted for substantially linear motion, the pawl being actuated by rotation of the lever and traveling substantially linearly between an open position to a closed position as the lever is rotated between the first position to second position;

wherein the pawl is mounted to travel between the open position along a first path and an intermediate position; and wherein the pawl is mounted to travel in a second path in a direction substantially perpendicular to the first path between the intermediate position and the closed position, wherein the second path is linear.

10. A linear compression latch according to claim 9 wherein the first path is linear.

11. A linear compression latch according to claim 9 further comprising a carriage, the carriage being mounted for linear motion within the housing, the pawl being mounted within the carriage, the carriage being displaced with the pawl as the pawl travels along the second path.

12. A linear compression latch according to claim 11 further comprising link means for linking the lever and the pawl.

13. A linear compression latch according to claim 12 further comprising connection means for rotatably connecting the link means and the pawl.

14. A linear compression latch according to claim 13 wherein the connection means also rotatably connects the pawl and the carriage.

15. A linear compression latch according to claim 14, the lever having a first arm and a second arm, the first and second arm being non-collinear.

* * * * *